US006223441B1

(12) United States Patent
Parsons

(10) Patent No.: US 6,223,441 B1
(45) **Date of Patent: *May 1, 2001**

(54) EMERGENCY WINDOW-BREAKING TOOL WITH QUICK-RELEASE CARRYING CASE

(75) Inventor: Kevin L. Parsons, Appleton, WI (US)

(73) Assignee: Armament Systems and Procedures, Inc., Appleton, WI (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/070,367

(22) Filed: Apr. 30, 1998

(51) Int. Cl.[7] ..... B26F 1/32
(52) U.S. Cl. ..... 30/367; 30/366
(58) Field of Search ..... 30/366–368, 162, 30/151

(56) References Cited

U.S. PATENT DOCUMENTS 949,470 2/1910 Geissenhainer et al. .
2,390,309 * 12/1945 Keys ..... 30/366 X
3,172,204 * 3/1965 Frey ..... 30/367
4,576,164 * 3/1986 Richeson ..... 30/162 X
5,097,599 3/1992 Hasegawa .
5,509,581 4/1996 Parsons .
5,657,543 8/1997 Collins .

FOREIGN PATENT DOCUMENTS

435627 * 9/1935 (GB) ..... 30/367

* cited by examiner

*Primary Examiner*—Douglas D. Watts
(74) *Attorney, Agent, or Firm*—McDonnell Boehnen Hulbert & Berghoff

(57) ABSTRACT

An emergency window-breaking tool is carried in a quick-release rigid, tubular carrying case. A pivoting locking mechanism or "safety" incorporated into the end of the carrying case secures the window-breaking tool in the carrying case when not in use, permitting the window-breaking tool and carrying case to be worn on the person without risk of injury. When the window-breaking tool is needed, the locking mechanism is moved to an open position, permitting the window-breaking tool to be quickly withdrawn from the carrying case. The tip of the tool comprises a reciprocating punch that is pressed against the glass. Inward movement of the punch activates a compressing spring driving mechanism for a hammer inside the tool. Upon sufficient compression of the driving mechanism, the hammer is tripped, imparting a sharp blow to the punch, causing the punch to shatter the glass.

15 Claims, 4 Drawing Sheets

76
108
110
115

84
72
90
74
98
76
66
110
108
56

71
101
72
74
99
76
97
56
66
32
98
97

F
32
80
72
99
90
66
98
110
108
56
76

EMERGENCY WINDOW-BREAKING TOOL WITH QUICK-RELEASE CARRYING CASE

BACKGROUND OF THE INVENTION

1. Field of the Invention

This invention relates generally to the field of police and law enforcement equipment. More particularly, the invention relates to a compact, hand-held window-breaking tool and a rigid, lightweight carrying case for the window-breaking tool that allows the window-breaking tool to be safely carried on the person, and yet be immediately accessible for use in an emergency.

2. Description of Related Art

In police, fire, and other public safety lines of work, circumstances occasionally arise in which a window needs to be broken immediately in order to gain access to a building or vehicle. For example, an unconscious or injured person or infant may be locked in an automobile that has caught on fire or is about to be submerged in a flood. In such circumstances, the immediate breaking of a window to either unlock the door or provide a means of egress from the vehicle may mean a matter of life or death for the person or persons trapped in the vehicle.

To effectuate the breaking of the window, it is known in the art to use window-breaking devices such as tactical police batons (either telescoping or fixed length), or small, hand-held window-breaking punches. An example of a baton specifically designed for use to break plate-glass type windows is described in U.S. Pat. No. 4,752,072, assigned to Armament Systems and Procedures, Inc., the assignee of the present invention. An expandable tactical baton for police use is described in U.S. Pat. No. 5,348,297 also assigned to Armament Systems and Procedures, Inc.

The prior art window-breaking techniques using batons have some drawbacks. First, the tempered glass found on the side windows of contemporary automobiles is extremely difficult to break with a police baton, even when a very hard blow is delivered. This is due to a number of factors, including the tempering of the glass, the molded contour of the window cushioning the blow, and rubber seals that absorb the force of the blow and allow the window to flex when the window is struck. Even if the blow is successful in breaking the window, the resulting follow-through will carry the baton into the interior of the vehicle. This presents a risk of occupant/baton impact, and will result in a curtain of sharp glass flying into the interior of the vehicle and onto the occupants.

Consequently, the prior art has developed small, hand-held window-breaking punches. These devices have an extremely hard and sharp steel punch and a hammer or other mechanism that delivers a short, sharp blow to the punch. The device is used by pressing the sharp steel tip of the punch against the glass and then tripping the hammer, which then delivers the blow to punch. The result is that the glass shatters, but since there is only a small impact force that is applied to the hardened tip, the glass does not fly. Rather, the shattered glass tends to fall by gravity proximate to its location in the vehicle door, dashboard, or side panel. Representative patents disclosing these types of punches include U.S. Pat. Nos. 5,657,543 and 5,097,599.

The small hand-held window-breaking punches offer an advantage over police batons in terms of window-breaking performance. However, some models of these punches found on the market today, in which the tip of the punch is exposed, cannot be safely carried on the person due to the risk of serious puncture wounds. In particular, if the window-breaking punch is carried in a shirt pocket by a police officer and the officer trips or falls, the tip of the punch can cause a serious puncture wound to the chest.

Even many bullet-proof vests worn by law enforcement officers fail to provide adequate protection. Many such vests include fibers which can deflect bullets. However, the point of a projectile or implement such as a knife, ice pick (or window breaking punch) may separate such fibers, such that the point passes through the fibers and into the body of the officer.

Because of the inherently dangerous nature of many types of window-breaking punches, law enforcement personnel have tended to carry them in their duty vehicle or attache case, or not use them at all. These circumstances lead to the situation that the device is not readily available for use when needed. Indeed, an officer may have only a few moments to extract the passenger of a vehicle that is on fire or about to be submerged under water. In such case, there simply may not be time to run back to the duty vehicle, or even open an attache case or other cumbersome container. As noted above, these devices can be needed in an instant, and any delay in obtaining the window punch can be a matter of life or death. The failure of a police baton to break the side windows of the automobile can also be potentially catastrophic.

The present invention provides an emergency window-breaking punch and associated quick-release carrying case that overcomes the problems of the prior art. The carrying case protects the user from possible puncture from the window-breaking punch, allowing the punch to be carried on the person without risk of injury. Further, the carrying case allows the window-breaking punch to be immediately retrieved and placed into use. A unique safety locking mechanism securely locks the punch in place inside the carrying case when not in use, and quickly releases to allow the punch to be removed from the carrying case and deployed in an instant.

Further, the carrying case can serve a number of other uses for the law enforcement officer besides carrying the window-breaking punch. For example, the carrying case can be used as a search tool in a pat-down type of search. The carrying case can also be used as a control tool to control a subject presenting a threat to the officer by applying the sides of the carrying case to vulnerable areas of the body, such as the wrist, or the tip of the carrying case to sensitive muscle groups or nerve centers.

SUMMARY OF THE INVENTION

An emergency window-breaking apparatus includes a window-breaking punch tool and a quick-release carrying case. The carrying case includes a hollow, open tubular housing having an upper aperture for receiving the window-breaking punch. The window-breaking punch is stored within and removable from the carrying case.

A pivoting locking member is provided on the carrying case to lock the window-breaking punch in place when not in use, and allow the punch to be quickly released and deployed. The window-breaking punch has a reduced-diameter neck portion that cooperates with the locking member to retain the punch within the carrying case. The locking member pivots relative to the carrying case housing between a first or closed position and a second or open position. In the closed position, the locking member engages the upper neck portion of the punch to securely retain the punch within the carrying case while still allowing the keys attached to the punch to swivel. In the open position, the locking member is pivoted away from the neck portion of the punch, permitting the punch to be removed from the carrying case.

The locking member is readily moved between the first and second positions by grasping the carrying case within one hand and moving the locking mechanism from the closed position to the open position with the thumb of the other hand. Once the locking mechanism is opened, the punch is quickly withdrawn from the carrying case and deployed. The punch is also quickly stowed in the carrying case and locked into place.

In a preferred embodiment, the punch includes a head portion at one end thereof adjacent to the neck portion. The head portion includes an aperture receiving a split ring. The split ring enables the carrying case to be attached to a set of car keys, or tucked into a duty belt with a reduced risk of falling out. The split ring also serves a grasping function. Once the locking member is opened, the user grasps the split ring to remove the punch from the carrying case.

The rigid carrying case for the punch is also of a size and shape that it functions well as a pat-down tool for police use. The carrying case can be easily tucked into the duty belt of the officer, with the split ring and keys preventing the carrying case from falling out. When the officer needs to use the carrying case as a pat down tool, or gain access to the punch, the officer grasps the split ring or keys and withdraws the carrying case from the belt. The punch can be accessed virtually immediately. Additionally, by virtue of the punch stored in the rigid carrying case when not in use, the punch is safely stored where it will not accidentally puncture the officer.

These and other features and advantages of the invention will be apparent from the following detailed description of a presently preferred embodiment of the invention.

BRIEF DESCRIPTION OF THE DRAWINGS

A presently preferred embodiment of the invention is described below with reference to the drawings, in which like reference numerals refer to like elements in the various views, and in which.

DETAILED DESCRIPTION OF THE PREFERRED EMBODIMENT OF THE INVENTION

Figure 1:
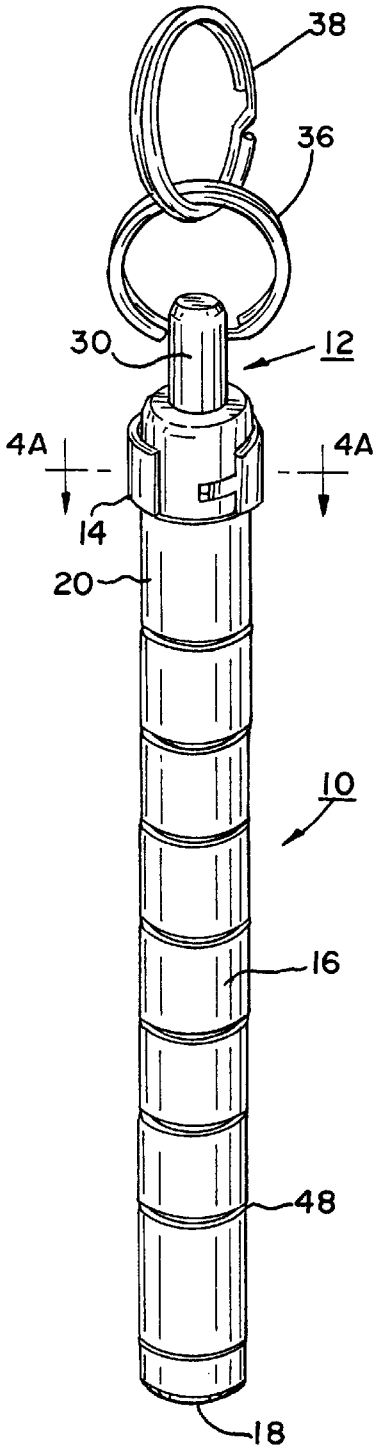
FIG. 1 is a perspective view of a carrying case or search tool that is used for carrying a window-breaking tool, with the window-breaking tool nested inside the carrying case and secured in place by a pivoting locking or safety member, which is shown in its closed position.
Figure 2:
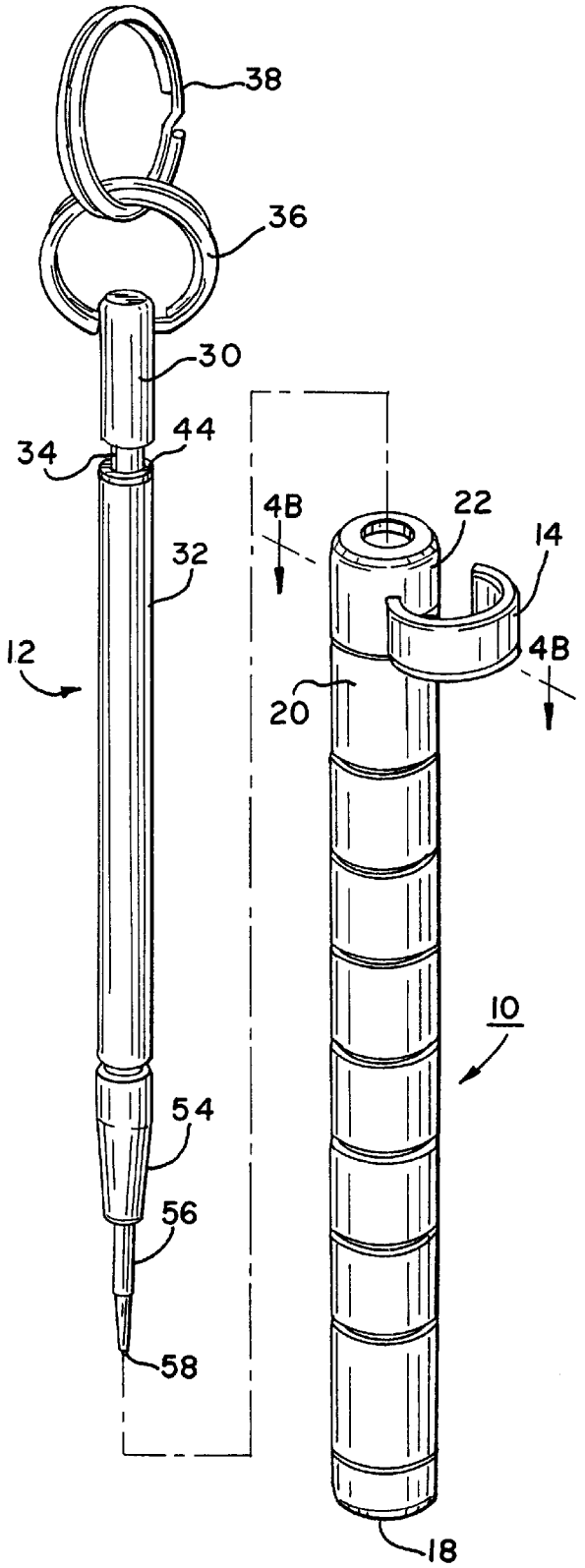
FIG. 2 is a perspective view of the carrying case and window-breaking tool of FIG. 1 in an exploded view, showing the pivoting locking member moved to an open position allowing the window-breaking tool to be removed from the carrying case.

Referring now to FIG. 1, a carrying case 10 in the form of a short baton or search tool is shown in a perspective view. The carrying case or baton 10 is used for carrying a window-breaking tool or punch 12. The window-breaking tool 12 nests inside the carrying case 10 and is secured in place by a pivoting, wrap-around locking or safety member 14, which is shown in its closed position in FIG. 1. FIG. 2 is a perspective view of the carrying case 10 and window-breaking tool 12 of FIG. 1 in an exploded view, showing the locking member 14 pivoted to an open position, thereby allowing the window-breaking tool 12 to be inserted into or withdrawn from the carrying case 10.

Figure 4A:
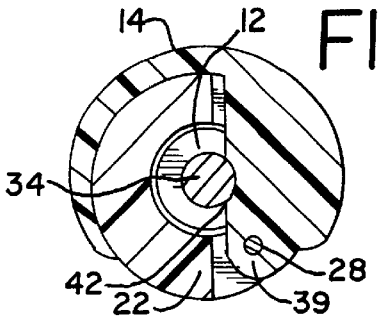
FIG. 4A is a sectional view taken through the carrying case and window-breaking tool along the lines 4A—4A of FIG. 1, showing the locking engagement of the locking member to the neck portion of the window-breaking tool when the locking member is in its closed position.
Figure 4B:
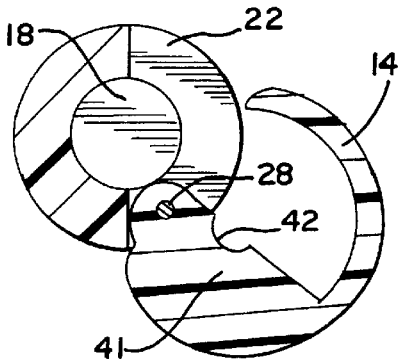
FIG. 4B is a sectional view of the carrying case of FIG. 2 taken along the lines 4B—4B of FIG. 2, showing the locking member pivoted to the open position allowing the window-breaking tool to be inserted into and withdrawn from the interior of the carrying case.
Figure 5A:
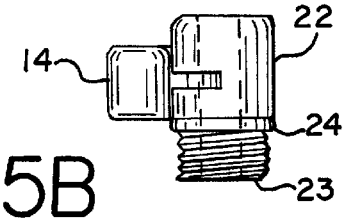
FIG. 5A is a elevational view of the detachable end cap of the carrying case that incorporates the locking member.
Figure 5B:
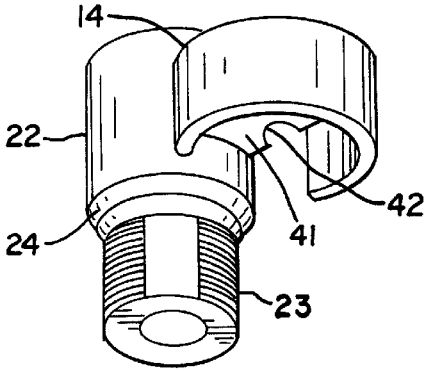
FIG. 5B is a perspective view of the end cap of FIG. 5A, as seen from below, with the locking member pivoted to an open position.
Figure 6:
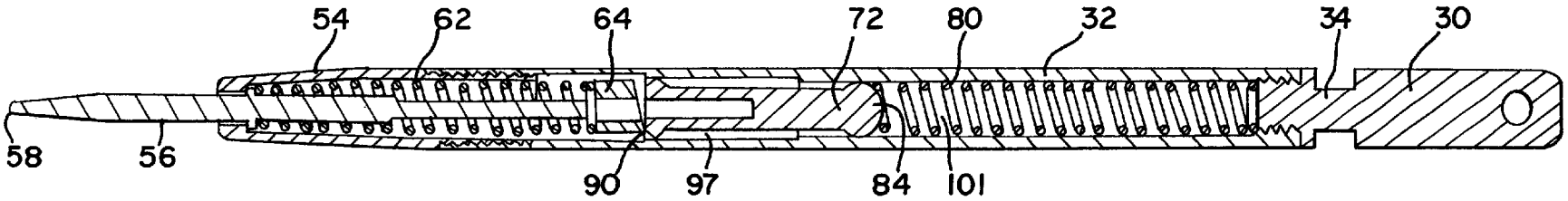
FIG. 6 is a cross-section of the window-breaking tool in a non-deployed condition.

The carrying case 10 preferably comprises an elongate, hollow, rigid tubular housing 16 having a closed end 18 and an open end 20. The closed end 18 of the carrying case may be integrally formed with the tubular housing 16, or, more preferably, may be formed by a separate end cap (not shown) that threads into complementary grooves provided in the tubular housing 16. At the open end 20, an end cap 22 (see FIGS. 5A and 5B) is provided that has threads 23 that engage complementary grooves provided within the open end 20 of the tubular housing 16. A rubber gasket 24 seals the connection between the end cap and the tubular housing 16. The end cap 22 includes a pin 28 (FIGS. 4A and 4B) that secures the locking member 14 to the end cap 22, and allows the locking member to pivot between the closed position and the open position. The closed position is shown in FIGS. 1 and 4A, in which the carrying case 10 secures the window-breaking tool 12 in place. The open position shown in FIGS. 2 and 4B, in which the window-breaking tool 12 can be withdrawn from the carrying case 10.

Figure 3:
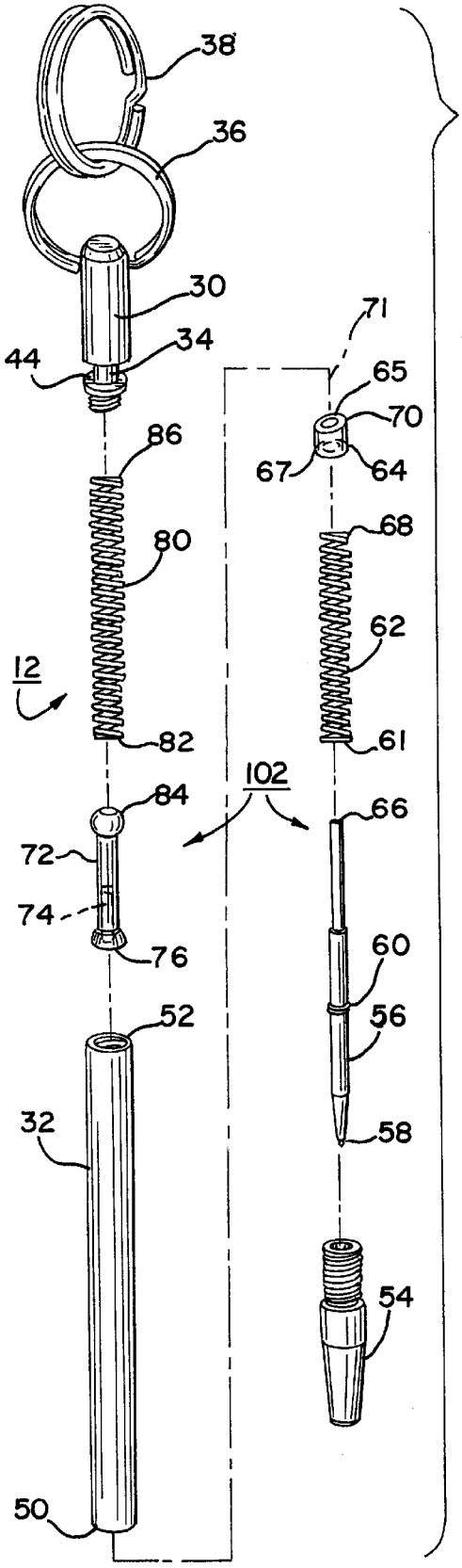
FIG. 3 is an exploded view of the window-breaking tool of FIG. 2.

Referring in particular to FIGS. 2 and 3, in a preferred embodiment the window-breaking tool 12 includes a head portion 30 that is attached to an elongate tubular hollow body 32. The head portion 30 includes a reduced diameter neck portion 34. The head portion also includes a aperture (not shown) that receives a split ring 36. The split ring 36 permits the carrying case 10 to be attached to a second split ring 38, such as the ring carrying the car keys of the police officer. When the carrying case 10 is tucked into a duty belt of an officer, the split rings also help prevent the carrying case from slipping out from the belt.

Referring to FIG. 1, note that the locking mechanism 14 locks the window-breaking tool 12 in a manner in which the head portion 30 of the tool protrudes past the end of the carrying case 10. This allows the user to visually observe the window-breaking tool in the carrying case. Further, when the locking mechanism 14 is opened, the head portion 30 and split rings 36 and 38 allow the window-breaking tool 30 to be immediately grasped and withdrawn from the carrying case 10, promoting a quick release of the window-breaking tool 12.

The reduced diameter neck portion 34 of the window-breaking tool 12 is designed to be secured by the pivoting locking member 14 to prevent accidental withdrawal of the tool 12 from the carrying case 10. With particular reference to FIGS. 1, 2, 4A, 4B, and 5B, the locking member includes a hinge portion 39 connected to an upper portion of the carrying case 10 and end cap 22 via the pin 28, and a flat shelf 41 incorporating a semicircular groove 42. When the window-breaking tool 12 is inserted into the carrying case 10 all the way such that the tip 58 contacts the end portion 18, the neck portion 34 is at the same elevation as the groove 42 and flat shelf portion 41 of the locking member 14. When the locking member 14 is moved to the closed position (FIG. 1), the groove 42 abuts the cylindrical neck portion 34. The adjacent surfaces of the shelf 41 abut the shoulder portion 44 of the head member 30, preventing withdrawal of the window-breaking tool 12 from the carrying case 10.

The assembly of FIG. 1 is particularly suitable for use as a pat-down or search-type baton or tool for police use when the window-breaking tool 12 is not needed. In particular, the officer can grasp the end 20 of the carrying case 10 with their fingers and use the distal portions of the housing 16 to pat down a subject. When not in use, the carrying case 10 can be readily tucked into the duty belt or other equipment worn about the waist of the officer, carried in a pants or shirt pocket, or attached to a key holder or key chain. The carrying case 10 is preferably made from a strong, rigid, lightweight metal material, such as aluminum alloy. The carrying case 10 is ideally on the order of 5–8 inches in length. In a preferred embodiment, the housing 16 is preferably painted a dark or black color to match the officer's uniform, and is provided with a plurality of distinctive circumferential grooves 48. However, other ornamentation may be provided to the exterior surface of the housing 16.

The window-breaking punch 12 per se will now be described in further detail with reference to FIGS. 2, 3, 6, 7 and 8. The window-breaking punch includes a hollow tubular housing 32 having a first end 50 and a second end 52. The head member 30 threads onto the second end 52 of the hollow tubular housing 32 to close off the housing and provide a seat for the main compression spring 80. A lower retaining collar 54 threads onto the first end 50 of the housing 32.

A punch assembly 102 is nested within the hollow tubular housing 32 and the collar 54. The punch assembly 102 includes an elongate punch 56 having a hardened, extremely sharp tip 58 that is pressed against the glass or window 100 (FIG. 7) to be broken. The sharp tip 58 of the punch is preferably made from a heat treated, hardened, high carbon steel alloy such as, for example, 4140 grade steel hardened by a quench and temper process to a hardness of 58–63 on the Rockwell C scale. Such details regarding the alloy steel for the tip are provided as exemplary information on the preferred embodiment, rather than as absolute requirements for the device. The punch 56 includes a retaining clip 60 that serves to limit downward travel of the punch 56 relative to the collar 54. The clip 60 also acts as the lower seat for the end 61 of a punch spring 62. The punch spring 62 serves to re-set the entire punch assembly after use and keep the tip of the punch against the glass during operation. The punch 56 includes an upper end portion 66.

A guide or collar 64 is placed within the first end 50 of tubular housing 32. The guide has a central aperture 65 for receiving the upper end 66 of the punch. The guide 64 includes a flat lower surface 67 that seats against the end 68 of the punch spring 62, and an upper slanted surface 70. The surface 70 has spherical depression formed therein with a ball cutter, and a smooth finish. The guide is also made from a steel case hardened to 58–63 on the Rockwell C scale.

Figure 7:
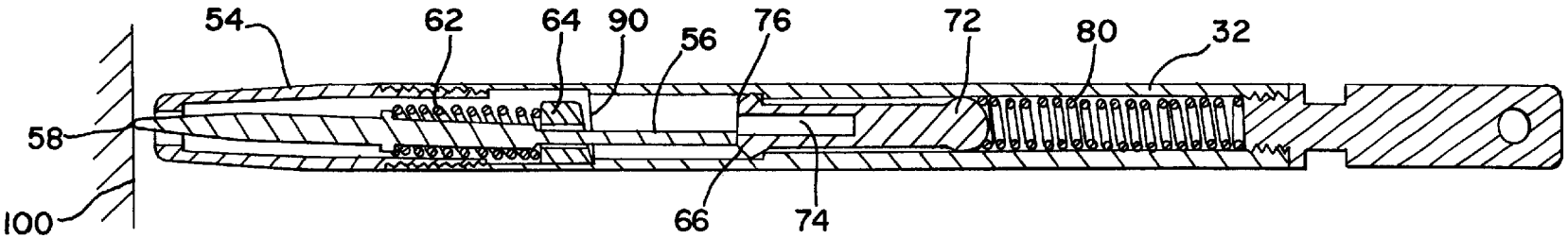
FIG. 7 is a cross section of the window-breaking tool during use to break a window, showing the punch in a retracted condition, immediately prior to the release of the hammer.

A hammer or plunger 72 is also positioned within the housing 32 above the guide 64. In a preferred embodiment, the hammer 72 is also a steel alloy hardened by tempering at 375 degrees F minimum to a surface hardness of between 58–63 Rockwell C. The hammer 72 has an open interior 74 that receives the upper end 66 of the punch 56 in the manner described below. The hammer 72 has a peripheral, ring-shaped flat lower flange surface 76 that slideably engages the upper, slanted surface 70 of the guide 64. The upper slanted surface 70 of the guide allows the surface 108 of the hammer to slide relative to the guide 64. This feature, in combination with the relatively wide diameter in the region 97 of the hollow tubular body 32 (FIG. 6), results in the hammer 72 being positioned in an off-set orientation relative to the center axis 71 of the punch assembly. When the punch tip 58 is pressed against the glass 100 and the punch 56 is moved inward relative to the retaining collar 54 (as shown in FIG. 7), the upper end 66 of the punch 56 makes contact with the peripheral lower surface 76 of the hammer 72 at region 110 (see FIGS. 9 and 10) and therefore does not immediately enter the interior recess 74 of the hammer 72. This feature will be more apparent with the discussion of FIGS. 6–10 below.

A main compression spring 80 is placed within the tubular body 32 above the hammer 72. The main compression spring 80 has a first end 82 seating against the upper head portion 84 of the hammer 72 and a second end 86 seating against the lower surface of the head member 30. The main compression spring 80 provides the driving force for the hammer 72 and punch 56 to break the glass in the manner described below in conjunction with FIGS. 7 and 8.

In operation, and with reference to FIGS. 3 and 6–10, a pressing of the tip 58 of the punch 56 against the glass 100 moves the punch 56 inward relative to the collar 54. An annular rim 90 inside the housing 32 prevents the guide 64 from moving upward. The end 66 of the punch 56 makes contact with the lower flange surface 76 of the hammer 72, specifically, the surface 110 of FIG. 10. Further compression forces the hammer 72 upwards against the restoring force of the spring 80 causes the punch 56 to lift the hammer 72 bodily upward (inward) towards to the head member 30, further compressing the spring 80.

Figures 8A, 8B, 9, 10:
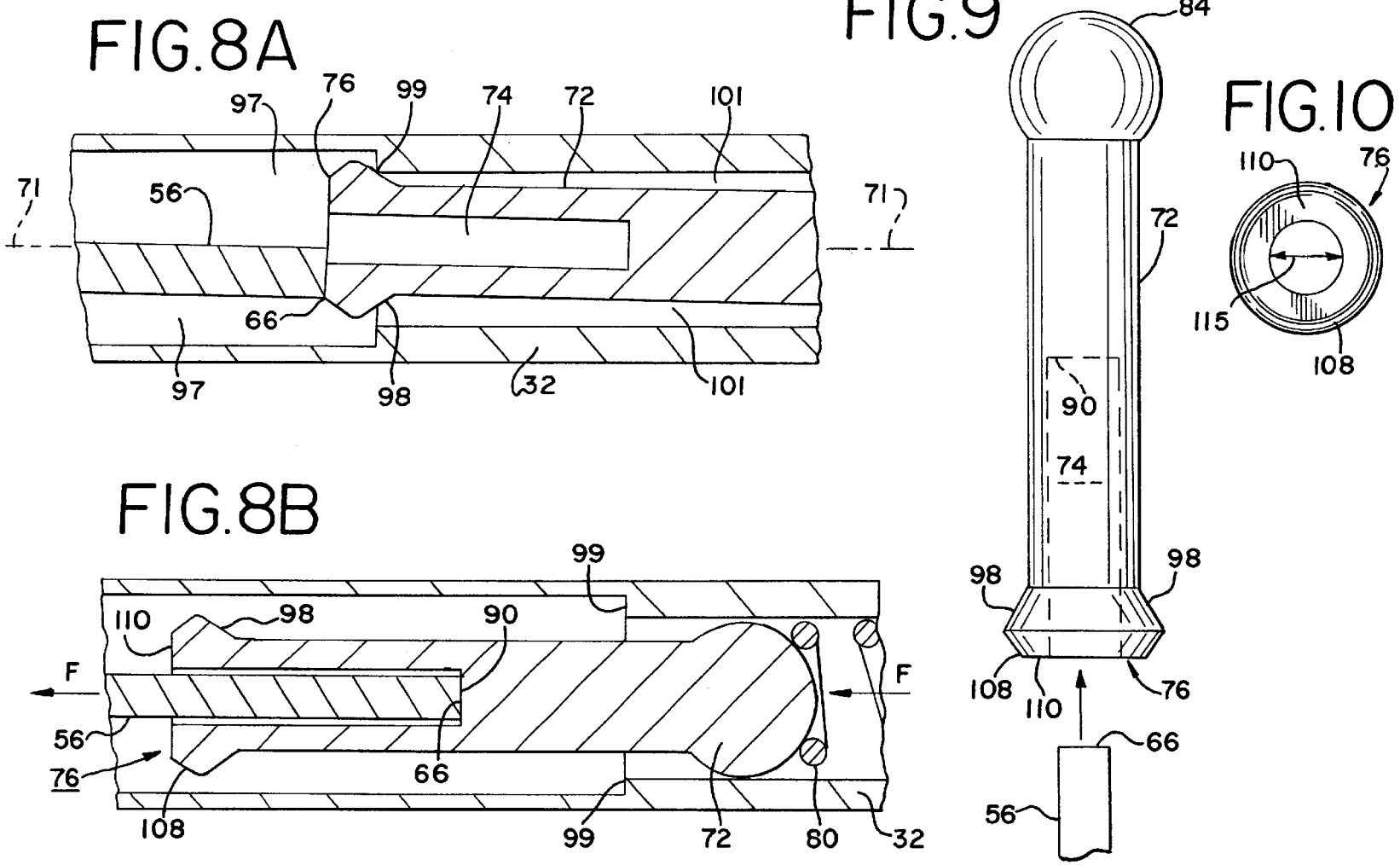
FIG. 8A is a partial sectional view of the window-breaking tool showing the upper end portion of the punch 56 abuting the lower flange surface 76 of the hammer 72, and showing how the reduced diameter feature of the tubular hollow body 32 engages a slanted surface 98 of the hammer to center the hammer within the tubular hollow body.
FIG. 8B is a partial sectional view of the window-breaking tool showing the upper end portion of the punch received within the hammer, allowing force applied to the hammer by the main compression spring to the transferred to the punch, enabling the punch to break the window.
FIG. 9 is a enlarged plan view of the hammer and end of the punch of FIG. 8; showing the flat end of the punch, the flat wall surface in the interior of the hammer, and the rounded corners at the lower flange surface of the hammer.
FIG. 10 is an end view of the hammer of FIG. 9.

When the hammer is in the region 97 of the tubular hollow body 32 (see FIG. 6), there is enough clearance between the side of the hammer and the interior surface of the tubular hollow body 32 to allow the hammer 72 to be tilted slightly and moved off-center relative to the central longitudinal axis 71 of the tubular hollow body. This tilting causes the upper end 66 of the punch 56 to abut the surface 110 of the hammer. However, as the hammer 72 is lifted upwards or inwards into the region of reduced diameter 101, the upper slanted surface 98 of the hammer (see FIG. 9) eventually abuts the corner 99 separating the larger diameter region 97 from the reduced diameter region 101, as shown in FIG. 8A. This produces a camming action, in which corner 99 abuts upper surface 98 to force the hammer to become centered about the longitudinal central axis 71 of the tubular hollow body as the hammer is moved further inward.

As the hammer 72 is centered about the central axis 71 of the punch assembly in the manner just described, the upper end 66 of the punch 56 slides from the surface 76 into the opening 115 and into the internal recess 74 of the hammer 72. This action abruptly releases the compression spring 80, causing the hammer 72 to rapidly move in the downward (outward) direction. The end wall 90 in the interior recess 74 of the hammer 72 delivers a sharp blow to the end 66 of the punch 56 (see force F in FIG. 8B). This force is translated to the tip 58 of the punch, breaking the glass 100.

The above process takes place in a small fraction of a second when the window-breaking tool 12 of FIGS. 2 and 7 is firmly pressed against the glass. Thus, the device can be very quickly deployed and used when the need arises. The officer simply opens the locking safety 14 with the thumb, grabs the window-breaking tool 12 with one hand and forces the tip 58 against the glass, causing the spring 80 to be compressed and tripping the hammer 72. The entire process takes place in about a second after a little practice. In addition, the punch assembly 102 is self-resetting. If the punch 56 does not break the glass the first time, the officer need only push it against the glass again for the mechanism to strike the glass a second time.

To insure effective operation of the punch 56 and hammer 72, a number of improvements have been made. Specifically, and with reference to FIG. 9, it was found that the interaction between the upper end 66 of the punch 56 and the bottom flange surface 76 of the hammer 72, and the interaction between the end 66 and the end wall 90 of the hammer 72 were critical to improving long term reliability and repeatability of the punch operation. These improvements include the following features:

1) The lateral portion of the flange surface 76 of the hammer 72 is preferably given a rounded contour 108, as shown in FIG. 9. This produces a somewhat reduced surface area at the medial surface 110 that is available to abut against the head 66 of the punch 56. Surprisingly, this reduction in the area of the contact at 110 actually promotes positive, reliable contact between the end 66 of the punch 56 and the surface 110 of the hammer.
2) The end wall 90 in the interior of the hammer 72 is square drilled and therefore substantially flat as shown in FIG. 9. Also, the end 66 of the punch 56 is flat. These features prevent the corners of the end 66 from becoming "peened" or rounded when the end wall 90 strikes the end 66 of the punch during use. A rounding of the end 66 is an undesirable result, since it would tend to result in the pin entering the cavity 74 in the hammer prematurely during use, resulting in less force being applied to the punch.
3) The size of the entrance opening 115 of the hammer 72 is adjusted slightly, i.e., reduced, so as to provide a larger area for surface 110.

Referring again to FIGS. 1–2, the split ring 36 attached to the head member assists the user in quickly removing the window-breaking tool 12 from the carrying case. In particular, the split ring 36 slips into the crook between the thumb and forefinger, allowing the fingers of the hand to securely grasp the housing 32 in one quick motion as the tool 12 is withdrawn from the carrying case 10.

Opening the carrying case 10 to deploy the window-breaking tool 12 requires affirmative movement in two different directions: rotation action of the locking member 14 to open the carrying case, and axial withdrawal of the window-breaking tool 12 from the carrying case. Thus, the carrying case design is less likely to open accidentally and less likely to cause injury. When the tool 12 is not deployed, the housing 16 of the carrying case, being in the form of an elongate tubular baton of roughly 5–8 inches in length, functions well as a search tool for probing the body of subject (particularly a female subject) in a pat-down search, in the manner described above. Further, because of the dual use of the carrying case 10, and the fact that police officers typically will carry such a search tool anyway, the present inventive carrying case and window-breaking tool can replace the single-function search tool entirely. The window-breaking tool is more likely to be available for use when needed to potentially save a life.

While a presently preferred embodiment of the invention has been set forth above, persons of skill in the art will appreciate that various modifications and alterations from the presently preferred embodiment of the carrying case and tool may be made without departure from the true spirit and scope of the invention. For example, reference to particular hardnesses values and materials that are considered the best mode for practicing the invention are not intended to the limit the scope of the invention. This scope is determined by the appended claims, interpreted in light of the foregoing.

What is claimed is:

1. An emergency window-breaking apparatus, comprising:

a carrying case comprising a hollow, open tubular housing having an upper aperture;

a window-breaking punch stored within and removable from said carrying case through said upper aperture, said punch comprising an upper neck portion; and a locking member hinged to said carrying case for retaining said punch within said carrying case, said locking member moveable relative to said housing to allow it to pivot between a first closed position and a second open position, said locking member in said first position cooperating with said upper neck portion of said punch to securely retain said punch within said carrying case, said locking member in said second position permitting said punch to be removed from said carrying case.

2. The apparatus of claim 1, wherein said punch further comprises a head portion proximate said neck portion and wherein said head portion comprises an aperture for receiving a split ring.

3. The apparatus of claim 1, wherein said carrying case comprises an elongate, rigid, tubular body adapted for use as a pat-down tool for police use.

4. The apparatus of claim 1, wherein said locking member further comprises:

(a) a hinge portion connected to an upper portion of said carrying case permitting said locking member to swing away from said carrying case to said second open position, and (b) a semicircular groove abutting said neck portion of said punch when said punch is positioned within said carrying case and said locking member is moved from said second open position to said first closed position.

5. The apparatus of claim 1, wherein said window-breaking punch comprises:

a hollow tubular housing having a first end and a second end;

a head member closing said second end of said hollow tubular housing; and a punch assembly nested within said hollow tubular housing, comprising:

an elongate punch body having a sharp tip for engaging a glass to be broken and a second end;

a guide placed within said tubular housing and having an central aperture for receiving said elongate punch body, an upper slanted surface and a lower surface;

a hammer having an open interior for receiving said second end of said elongate punch body, said hammer placed within said tubular housing, said hammer having a lower surface engaging said upper surface of said guide;

a main compression spring placed within said tubular housing between said head member and said hammer for providing driving forces for said hammer; and a punch spring having a first end engaging said punch and a second end seating against said lower surface of said guide;

wherein compression of said punch body against said glass forces said second end of said punch body inwards against said hammer so as to move said hammer towards said head member and compress said main compression spring, and wherein upon sufficient compression of said main compression spring said hammer and said second end of said punch body undergo relative movement so as to permit said second end of said punch body to enter said open interior of said hammer, releasing said compression spring and causing said hammer to deliver a sharp blow to said punch body to break said glass.

6. An emergency window-breaking tool, comprising:

a hollow tubular housing having a first end and a second end;

a head member closing said second end of said hollow tubular housing; and a punch assembly nested within said hollow tubular housing, comprising:

an elongate punch body having a sharp tip for engaging a glass to be broken and a second end;

a punch guide placed within said tubular housing and having a central aperture for receiving said elongate punch body, an upper slanted end surface and a lower end surface;

a hammer having an open interior for receiving said second end of said elongate punch body, said hammer placed within said tubular housing, said hammer having a lower surface engaging said upper surface of said guide;

a main compression spring placed within said tubular housing between said head member and said hammer for providing driving forces for said hammer; and a punch spring having a first end engaging said punch and a second end seating against said lower surface of said guide;

wherein compression of said punch body against said glass forces said second end of said punch body inwards against said hammer so as to move said hammer towards said head member and compress said main compression spring, and wherein upon sufficient compression of said main compression spring said hammer and said second end of said punch body undergo relative movement so as to permit said second end of said punch body to enter said open interior of said hammer, releasing said compression spring and causing said hammer to deliver a sharp blow to said punch body to break said glass.

7. The punch of claim 6, wherein said head member comprises a tubular body having a first portion threadably engaging said hollow tubular housing, a second portion, and a reduced diameter cylindrical neck portion integral with said first and second portions connecting said first portion with said second portions together.

8. The punch of claim 7, wherein said second portion of said head member further comprises an aperture receiving a split ring.

9. An emergency window-breaking apparatus, comprising:

a baton comprising an elongate, hollow, rigid tubular housing having a closed end and an open end;

an end cap threadably engaging said open end of said tubular housing;

a window-breaking tool stored within and removeable from said baton, said tool comprising a punch having a sharp point at a first end thereof, a reduced diameter neck portion at a second end thereof, and a driving mechanism for driving said sharp point into a glass to be broken upon compression of punch against said glass; and a pivoting locking member mounted to said end cap for securely locking said window-breaking tool within said baton, said locking member moveable relative to said tubular housing and end cap between a first closed position and a second open position, said locking member in said first position cooperating with said reduced diameter neck portion of said window-breaking tool to securely retain said window-breaking tool within said baton, said locking member pivoting away from said end cap in said second position to permit said window-breaking tool to be removed from said baton.

10. The apparatus of claim 9, wherein said window-breaking tool further comprises a head portion proximate said reduced diameter neck portion and wherein said head portion comprises an aperture for receiving a split ring.

11. The apparatus of claim 9, wherein said baton further comprises an exterior surface having a plurality of circumferential grooves.

12. The apparatus of claim 9, wherein said baton has a length of between 5 and 8 inches.

13. The apparatus of claim 5, wherein said lower surface of said hammer comprises a substantially rounded peripheral portion and a flat medial portion, said second end of said punch body engaging said flat medial portion of said hammer.

14. In a punch assembly for breaking a window comprising a punch, a hammer, a punch spring, and a main spring, the punch reciprocating within a guide collar to make contact with a lower flat surface of said hammer, said hammer having an open interior, the punch capable of moving said hammer by use of said punch spring against the biasing force of said main spring such that said hammer is moved to allow the punch to enter the open interior of said hammer, thereby releasing compression of said main spring, an improvement to said punch assembly, comprising:

said lower surface of said hammer being provided with a substantially rounded peripheral surface and a flat medial surface.

15. The improvement of claim 14, wherein said punch comprises a tip portion and an opposite end portion and wherein said hammer comprises an end wall for striking said head portion of said punch when said punch is moved into said hammer, and wherein said opposite end portion and said end wall comprise substantially flat surfaces so as to prevent a rounding of said opposite end portion of said punch when said punch is struck by said end wall.

* * * * *